US006811942B2

(12) United States Patent
Nakashima

(10) Patent No.: US 6,811,942 B2
(45) Date of Patent: Nov. 2, 2004

(54) TONER AND IMAGE FORMING APPARATUS

(75) Inventor: Yoshihiro Nakashima, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 132 days.

(21) Appl. No.: 10/113,959

(22) Filed: Apr. 2, 2002

(65) Prior Publication Data

US 2002/0164536 A1 Nov. 7, 2002

(30) Foreign Application Priority Data

Apr. 3, 2001 (JP) ..... 2001-104716
Apr. 3, 2001 (JP) ..... 2001-104717
Apr. 3, 2001 (JP) ..... 2001-104718
Apr. 3, 2001 (JP) ..... 2001-104719

(51) Int. Cl.[7] ..... G03G 9/08
(52) U.S. Cl. ..... 430/111.4; 430/108.6; 399/320
(58) Field of Search ..... 430/111.4, 108.6; 399/320

(56) References Cited

U.S. PATENT DOCUMENTS 6,183,928 B1 2/2001 Sata et al.
6,214,510 B1 * 4/2001 Kojima et al. ..... 399/252
6,558,865 B2 * 5/2003 Endo et al. ..... 430/108.6

FOREIGN PATENT DOCUMENTS

| | | |
|---|---|---|
| EP | 0 977 092 A2 | 2/2000 |
| EP | 0 999 478 A1 | 5/2000 |
| JP | 2000-047425 | 2/2000 |

OTHER PUBLICATIONS

Japanese Abstract No.: 2000284524, dated Oct. 13, 2000.
Database WPI, XP002244626, Japanese Abstract No.: 05 119514, dated May 18, 1993.

* cited by examiner

*Primary Examiner*—John L Goodrow
(74) *Attorney, Agent, or Firm*—Sughrue Mion, PLLC

(57) ABSTRACT

A toner is characterized in that an external additive coating ratio of toner particles of which mother particles have equivalent particle diameters larger than the mean particle diameter of the toner is set to be lower than a virtual reference curve in synchronous distribution of the equivalent particle diameters of synchronous external additive particles relative to the equivalent particle diameters of mother particles, wherein assuming that the external additive coating ratio of a toner particle of which a mother particle has an equivalent particle diameter equal to the mean particle diameter of the toner is a reference value, the virtual reference curve is obtained to satisfy that the external additive coating ratio is constant at the reference value. An image forming apparatus utilizing the above-described toner is also contemplated.

17 Claims, 4 Drawing Sheets

TONER AND IMAGE FORMING APPARATUS

BACKGROUND OF THE INVENTION

The present invention relates to a toner and an image forming apparatus which help for achieving a fusing unit having a simple structure and can prevent the occurrence of filming on a developing unit.

FIG. 1 is an illustration for explaining a conventional image forming apparatus with an intermediate transfer member. A rotary developing unit 1 comprises developing rollers of four colors: Y, M, C, K. The developing unit 1 turns to bring every one of the developing rollers in contact with the photoreceptor 2 for every rotation of a photoreceptor 2, just like a revolver. After the photoreceptor 2 is uniformly charged by a charging unit 3, images for the respective colors are exposed to light so as to form electrostatic latent images on the photoreceptor 2. The photoreceptor 2 comes in contact with the developing rollers Y, M, C, K to develop respective color images. Because of contact between the photoreceptor 2 and an intermediate transfer member 5, these color images are transferred to the intermediate transfer member 5 (primary transfer). Residual toner particles remaining on the photoreceptor after the transfer are removed by a cleaning unit 4. As the four color images are superposed on each other on the intermediate transfer member 5, a paper 8 is conveyed and a secondary transfer roller 7 is brought in contact with the paper 8. At this point, secondary transfer bias voltage is applied by a power source, not shown, so as to transfer the superposed color images to the paper 8 at once (secondary transfer). The secondary transfer roller 7 can swing to come in contact with the intermediate transfer member 5 in the direction of the double arrow. While color images are primary transferred and toned on the intermediate transfer member 5, the secondary transfer roller 7 is spaced apart from the intermediate transfer member 5. During the secondary transfer, the secondary transfer roller 7 is in contact with the intermediate transfer member 5 via the paper. Residual toner particles remaining on the intermediate transfer member 5 after the secondary transfer are removed by a cleaning unit 6.

In the image forming apparatus having the aforementioned structure, as shown in FIG. 2, the paper 8 with a transferred multi-color image is passed through a fusing unit composed of a heat roller 10 and a buck-up roller 11, thereby fusing the toner on the paper. However, the fusing unit of this type has disadvantages that a paper may be caught by the heat roller and that melt toner is caused, resulting in "hot offset". To prevent these problems, as shown in FIG. 3, an oil application roller 12 is provided to apply oil to the heat roller 10.

Conventionally, the problems of the fusing unit such as catching a paper and "hot offset" have been solved by applying oil to the heat roller to improve the release characteristics between the toner and the heat roller. This method, however, requires the control for applying oil, resulting in a complex structure and an expensive and large fusing unit, and requires the replacement of the oil application roller, losing user's convenience. To solve these problems, another method without using the oil application roller, so-called "oil-less fusing method" has been proposed. This method is improving the release characteristics by using fluorocarbon material as the outer layer of the heat roller and increasing the amount of wax to the toner.

Now, description will be made as regard to the developing unit. As shown in FIG. 4, a supply roller 21 rotates in a direction opposite to the rotational direction of a developing roller 20 and is arranged to be in contact with the developing roller 20 so as to rub the toner onto the surface of the developing roller 20 to cause frictional electrification. A regulating blade 22 regulates the toner on the surface of the developing roller 20 into a predetermined thickness and uniformly charging the toner. After that, the toner on the developing roller 20 is supplied to the photoreceptor 2. When the amount of wax contained in the toner is large, some toner particles adhere to the regulating blade 22, thus leading to the occurrence of filming. For example, when an image of light duty is developed, toner particles are selected to be used so that toner particles of large particle size and small particle size are left in the developing unit. These left toner particles are also used when suitable toner particles are consumed. As the concentration of toner particles of small particle size is accordingly increased, such particles remain in concavities of the surface of the developing roller for a long time, thus leading to the occurrence of filming on the regulating blade. In case of using a toner including a large amount of wax for achieving "oil-less fusing method", when heat and pressure are applied to the toner within the developing unit, the wax adheres to the regulating blade. This may cause filming at relatively earlier stage and may shorten the life of the developing unit as compared to the conventional one.

SUMMARY OF THE INVENTION

It is an object of the present invention to solve the aforementioned problems and to achieve both the "oil-less fusing" and the elongation of lifetime of a developing unit.

Therefore, the first aspect of the present invention is a toner being characterized in that the external additive coating ratio of toner particles of which mother particles have equivalent particle diameters larger than the mean particle diameter of the toner is set to be lower than a virtual reference curve in synchronous distribution of the equivalent particle diameters of synchronous external additive particles relative to the equivalent particle diameters of mother particles, wherein assuming that the external additive coating ratio of a toner particle of which a mother particle has an equivalent particle diameter equal to the mean particle diameter of the toner is a reference value, the virtual reference curve is obtained to satisfy that the external additive coating ratio is constant at the reference value.

The first aspect of the present invention is also characterized in that the external additive coating ratio at the reference value is in a range from 80% to 120%.

The first aspect of the present invention is further characterized in that the mean particle diameter of synchronous toner particles with external additive particles adhering thereto is set to be smaller than the means particle diameter of the entire toner, whereby the external additive coating ratio of toner particles with diameters larger than the mean particle diameter of the toner is set to be lower.

The first aspect of the present invention is furthermore characterized in that the liberated particle ratio of mother particles with diameters smaller than the mean particle diameter of the toner is set to be lower than the liberated particle ratio of mother particles with diameters larger than the means particle diameter of the toner, whereby the external additive coating ratio of toner particles with diameters larger than the mean particle diameter of the toner is set to be lower.

The second aspect of the present invention is a toner being characterized in that the external additive coating ratio of toner particles of which mother particles have equivalent particle diameters smaller than the roughness of a developing roller is set to be higher than a virtual reference curve in synchronous distribution of the equivalent particle diameters of synchronous external additive particles relative to the equivalent particle diameters of mother particles, wherein assuming that the external additive coating ratio of a toner particle of which a mother particle has an equivalent particle diameter equal to the roughness of the developing unit is a reference value, the virtual reference curve is obtained to satisfy that the external additive coating ratio is constant at the reference value is a reference.

The second aspect of the present invention is further characterized in that the external additive coating ratio at the reference value is in a range from 80% to 120%.

The second aspect of the present invention is furthermore characterized in that the mean particle diameter of synchronous toner particles with external additive particles adhering thereto is set to be smaller than the means particle diameter of the entire toner, whereby the external additive coating ratio of toner particles with diameters smaller than the roughness of the developing roller is set to be higher.

The second aspect of the present invention is still further characterized in that the liberated particle ratio of mother particles with diameters smaller than the roughness of the developing roller is set to be lower than the liberated particle ratio of mother particles with diameters larger than the roughness of the developing roller, whereby the external additive coating ratio of toner particles with diameters smaller than the roughness of the developing roller is set to be higher.

The third aspect of the present invention is a toner being characterized in that the external additive coating ratio of toner particles of which mother particles have equivalent particle diameters larger than the roughness of a developing roller is set to be higher than a virtual reference curve in synchronous distribution of the equivalent particle diameters of synchronous external additive particles relative to the equivalent particle diameters of mother particles, wherein assuming that the external additive coating ratio of a toner particle of which a mother particle has an equivalent particle diameter equal to the roughness of the developing unit is a reference value, the virtual reference curve is obtained to satisfy that the external additive coating ratio is constant at the reference value is a reference.

The third aspect of the present invention is further characterized in that the external additive coating ratio at the reference value is in a range from 80% to 120%.

The third aspect of the present invention is furthermore characterized in that the mean particle diameter of synchronous toner particles with external additive particles adhering thereto is set to be larger than the means particle diameter of the entire toner, whereby the external additive coating ratio of toner particles with diameters larger than the roughness of the developing roller is set to be higher.

The third aspect of the present invention is still further characterized in that the liberated particle ratio of mother particles with diameters smaller than the roughness of the developing roller is set to be higher than the liberated particle ratio of mother particles with diameters larger than the roughness of the developing roller, whereby the external additive coating ratio of toner particles with diameters larger than the roughness of the developing roller is set to be higher.

The fourth aspect of the present invention is a toner being characterized in that the external additive coating ratio of toner particles of which mother particles have equivalent particle diameters smaller than the mean particle diameter of the toner is set to be lower than a virtual reference curve in synchronous distribution of the equivalent particle diameters of synchronous external additive particles relative to the equivalent particle diameters of mother particles, wherein assuming that the external additive coating ratio of a toner particle of which a mother particle has an equivalent particle diameter equal to the mean particle diameter of the toner is a reference value, the virtual reference curve is obtained to satisfy that the external additive coating ratio is constant at the reference value is a reference.

The fourth aspect of the present invention is further characterized in that the external additive coating ratio at the reference value is in a range from 80% to 120%.

The fourth aspect of the present invention is furthermore characterized in that the mean particle diameter of synchronous toner particles with external additive particles adhering thereto is set to be larger than the means particle diameter of the entire toner, whereby the external additive coating ratio of toner particles with diameters smaller than the mean particle diameter of the toner is set to be lower.

The fourth aspect of the present invention is still further characterized in that the liberated particle ratio of mother particles with diameters smaller than the mean particle diameter of the toner is set to be higher than the liberated particle ratio of mother particles with diameters larger than the means particle diameter of the toner, whereby the external additive coating ratio of toner particles with diameters smaller than the mean particle diameter of the toner is set to be lower.

The fifth aspect of the present invention is an image forming apparatus comprising at least a latent image carrier on which an electrostatic latent image is formed, a developing unit for developing the electrostatic latent image on the latent image carrier with a toner, a transfer means for transferring the developed image on the latent image carrier, and a fusing means for fusing the transferred image, the image forming apparatus being characterized in that said toner is a toner of any one of the aforementioned aspects.

DESCRIPTION OF THE PREFERRED EMBODIMENTS

First, the particle diameter of each equivalent particle used in each aspect of the present invention will be described.

For analyzing toner particles according to the particle analyzing method, toner particles are introduced into plasma, thereby exciting the toner particles to emit light. The toner particles are composed of mother particles made of resin (carbon) such as polyester and external additive particles such as silica (silicon oxide). The mother particles are coated with the external additive particles to improve the fluidity and the charging property of the toner. During light emission of the toner, the emission spectrum (frequency) peculiar to its elements and the intensity of emitted light depending on the number of atoms of its elements are obtained. From the measured values of the emission frequency and the intensity, the number of atoms (mass) of the elements composing the mother particles and the external additive particles can be given. For analysis, the mass of elements composing the mother particles and the mass of elements composing the external additives can be converted to perfect spheres, respectively. The perfect spheres are called equivalent particles, and the particle diameter of each equivalent particle is called an equivalent particle diameter which can be expressed as cubic-root voltage of the signal intensity of emission spectrum (proportional to the mass) to be measured (Japanese Patent Unexamined Publication H12-47425).

Figure 1:
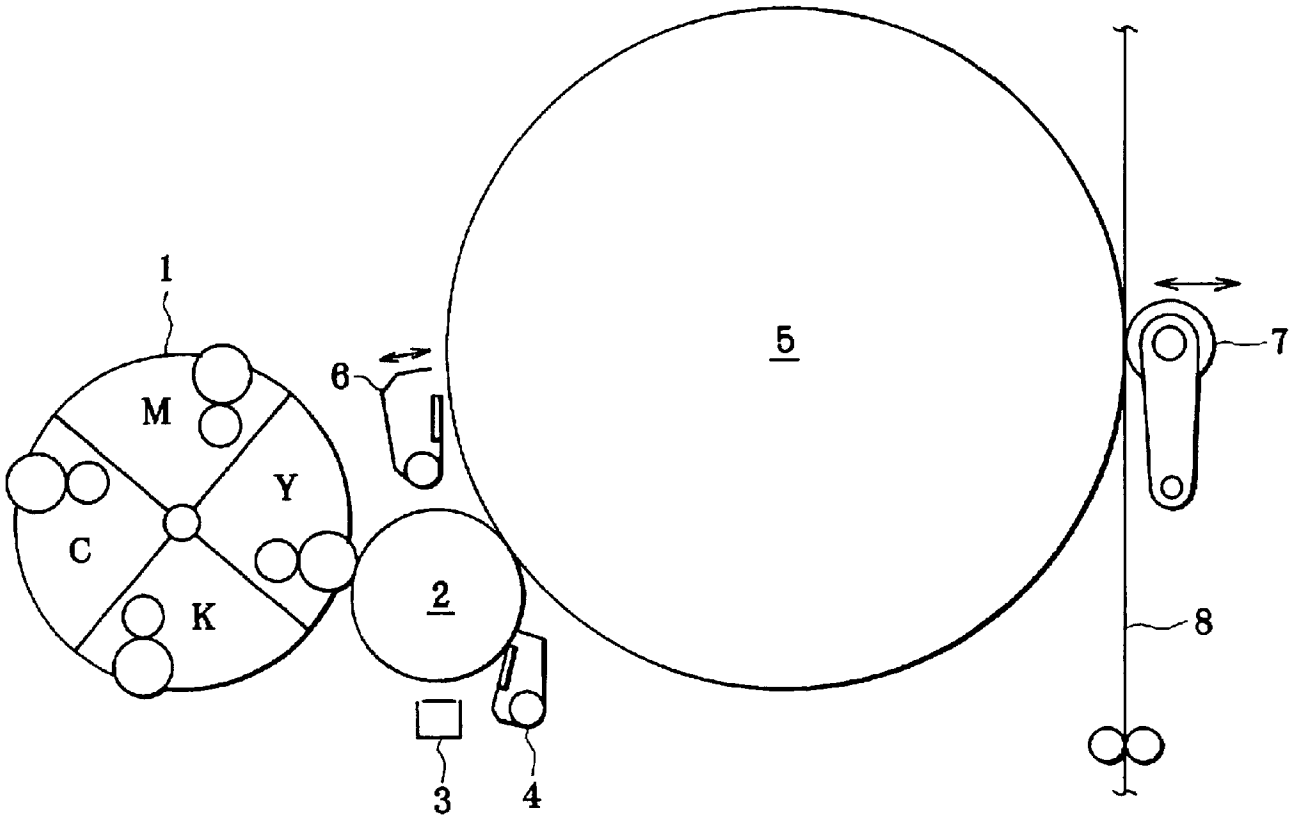
FIG. 1 is an illustration for explaining an image forming apparatus with an intermediate transfer member.
Figure 2:
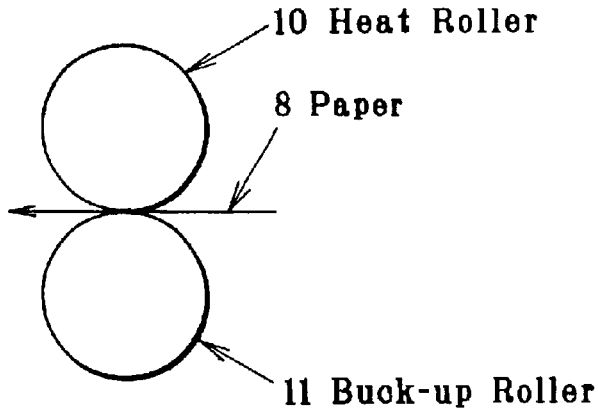
FIG. 2 is an illustration for explaining a heat roller fusing unit.
Figure 3:
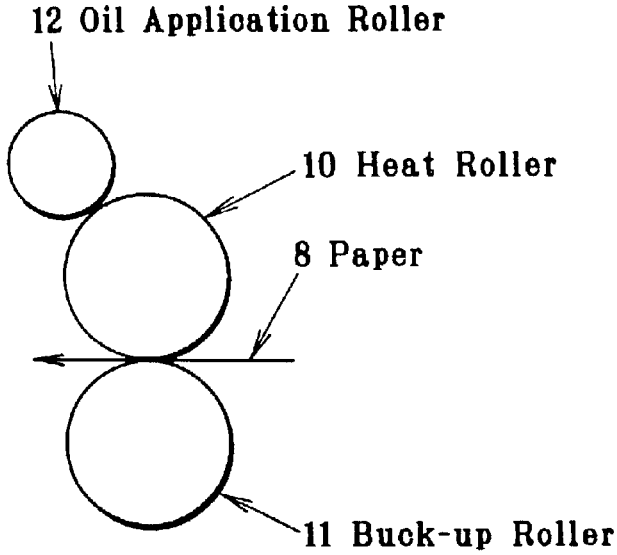
FIG. 3 is an illustration for explaining a fusing unit having an oil application roller.
Figure 4:
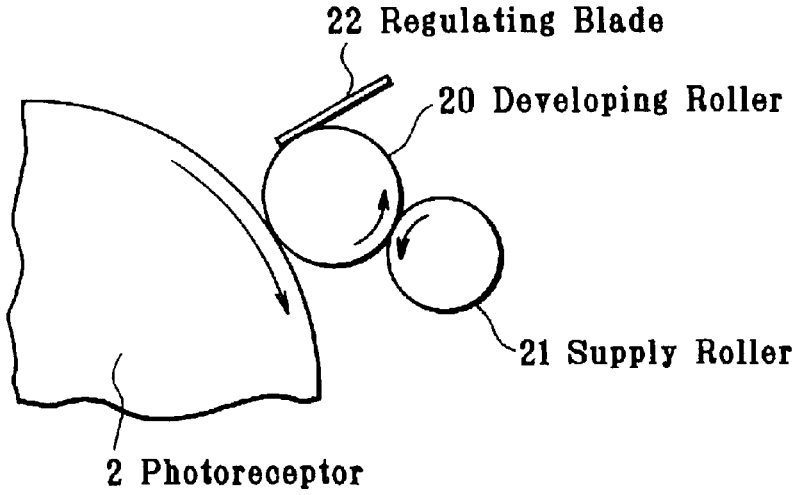
FIG. 4 is an illustration for explaining a developing unit.
Figure 5:
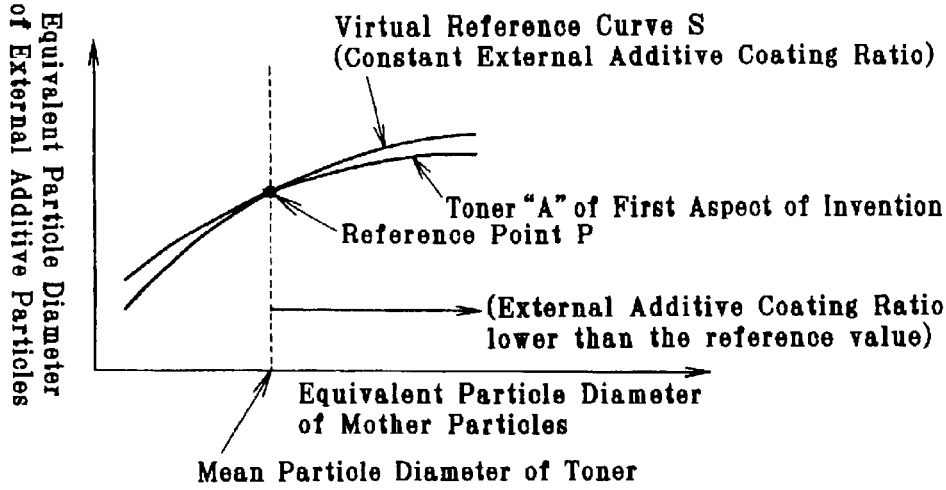
FIG. 5 is a graph for explaining a synchronous distribution curve defining a toner of the first aspect of the invention.

According to the particle analyzing method, the toner in which the mother particles and the external additive particles adhere to each other is called as a toner in synchronized state (synchronous toner particles) because the light emission of the mother particles and the light emission of the external additive particles are detected simultaneously. The toner in which the mother particles and the external additive particles are liberated from each other is called as a toner in the non-synchronized state (asynchronous toner particles) the light emission of the mother particles and the light emission of the external additive particles are detected at different times. Plotted on the abscissa and the ordinate of FIG. 5 are asynchronous toner particles. Asynchronous mother particles are plotted on the abscissa and asynchronous external additive particles are plotted on the ordinate. Plotted on any other points are synchronous toner particles. The plotting position is defined by a ratio of the amount of mother particles and the amount of external additive particles.

When external additive particles are uniformly distributed inside (entrapped in) the mother particles, the synchronous distribution is represented by a straight line because the amount of the mother particles and the amount of the additive particles are both proportional to the cube of the particle diameters (their particle diameters). When external additive particles adhere to only the surfaces of mother particles, the synchronous distribution is represented by a curve of the (2/3) power because the amount of the mother particles is proportional to the cube of the particle diameter and the amount of the external additive particles is proportional to the surface area, i.e. the square of the particle diameter, of the mother particles. Therefore, when the external additive coating ratio on the surface of any mother particle is constant, the synchronous distribution is represented by a curve of the (2/3) power just like a virtual reference curve S in FIG. 5. Assuming that external additive particles are added into the toner by a constant rate, as the ratio of liberated external additive particles increases, the ratio of synchronous external additive particles decreases so that the slope of the synchronous distribution curve decreases. On the other hand, as the ratio of liberated external additive particles decreases, the ratio of synchronous external additive particles increases so that the slope of the synchronous distribution curve increases. In this manner, the adhering state of external additive particles to mother particles can be analyzed.

The external additives are added to toner particles by using a mixing machine, such as a V-type blender, a Henchel mixer, or a Loedige mixer. A vibrating screen or an air classifier may be used for removing bulky particles of toner. For selectively changing the adding amount of external additives according to the diameter of the toner particles, the toner particles are classified into several groups according to the particle diameter. The process of adding external additive particles is conducted for each group and after that, these groups are blended. In this manner, the different coating ratios according to the particle diameters can be achieved.

The property required for toner to improve the durability of the developing unit is softening the stress on the mother particles applied from the developing roller and the regulating blade. Strengthening the mother particles themselves against the stress is effective. However, in case of toner prepared by pulverization and containing a great amount of wax for achieving the "oil-less fusing", the effect may not be expected because wax component is exposed to the surfaces at a certain rate. For softening the stress to the toner, there is a method of acting the external additive particles adhering to the surfaces of the mother particles as a spacer for absorbing the stress from the regulating blade.

FIG. 5 is a graph for explaining a synchronous distribution curve for defining a synchronous toner indicating the ratio of the amount of mother particles and the amount of external additive particles adhering to the mother particles in a toner of the first aspect of the invention. The abscissa stands for the equivalent particle diameter of the mother particles and the ordinate stands for the equivalent particle diameter of the external additive particles.

A toner of the first aspect of the present invention will now be described. It is assumed that the external additive coating ratio of a toner particle of which a mother particle has an equivalent particle diameter equal to the mean particle diameter of the toner is a reference value (80–120%). A virtual reference curve S passing through a reference point P is plotted to satisfy that the external additive coating ratio is constant at the reference value. The toner is prepared in such a manner that the external additive coating ratio of toner particles of which mother particles have equivalent particle diameters larger than the mean particle diameter of the toner is set to be lower than the virtual reference curve S so that the "oil-less fusing" and the elongation of the lifetime of the developing unit are both achieved.

Figure 6:
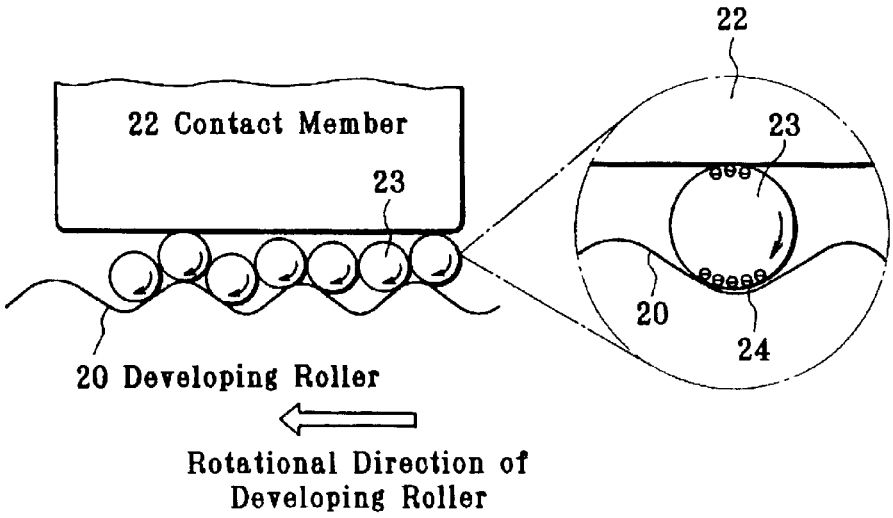
FIG. 6 is an illustration for explaining occurrence of filming on a developing roller.

As shown in FIG. 6, toner particles 23 are conveyed to pass between the developing roller 20 and a contact member 22. During this, the toner particles 23 roll along the concavities and convexities of the developing roller. Small toner particles are easy to enter into the concavities of the developing roller, thus leading to the occurrence of filming. Large toner particles are difficult to stay in the concavities. Therefore, toner particles with diameters larger than the mean particle diameter of the toner are hardly affected by heat even with a low external additive coating ratio because they do not stay in the concavities of the developing roller, so no filming occurs. On the other hand, because of the lower external additive coating ratio, the wax is easily exposed to the surfaces, thereby improving the fusing property. As mentioned above, by setting the external additive coating ratio of toner particles with diameters larger than the mean particle diameter of the toner to be lower, the fusing property is improved and the occurrence of filming on the developing unit can be prevented, thereby enabling that the "oil-less fusing" and the elongation of the lifetime of the developing unit are both achieved.

Since small toner particles are easy to stay in the concavities of the developing roller and thus easily affected by heat, the external additive coating ratio is preferably set to be higher than the virtual reference coating ratio curve S (FIG. 5) so that the small toner particles are coated enough with external additive particles, thereby preventing the occurrence of filming on the developing unit. In case of the small toner particles, since the surface area relative to the mass should be large, the small toner particles are easy to receive heat during fusing so that there is little affect on the fusing property even with large external additive coating ratio.

The first aspect of the invention is not limited to the toner containing wax and may be adopted to a toner made of low melting point resin without containing wax.

Though the above description was made based on the synchronous distribution curve of the external additive coating ratios, the first aspect of the invention is not limited thereto. For example, assuming that the mean particle diameter of entire toner including synchronous toner particles coated with external additive particles and asynchronous toner particles coated with no or little external additive particles is $D_{total}$ and the mean particle diameter of synchronous toner particles is $D_{doki}$, the toner may be prepared to satisfy the following equation:

$$D_{doki}/D_{total} \leqq 1.$$

Accordingly, the large toner particles are coated with external additive particles at a small coating ratio and the small toner particles are coated enough with external additive particles, thereby preventing the occurrence of filming and ensuring well fusing.

Alternatively, assuming that the liberated particle ratio of mother particles with particle diameters smaller than the mean particle diameter is $\alpha A$ and the liberated particle ratio of mother particles with particle diameters larger than the mean particle diameter is $\alpha B$, the toner may be prepared to satisfy the following equation:

$$\alpha A/\alpha B \leqq 1.$$

Accordingly, the large toner particles are coated with external additive particles at a small coating ratio and the small toner particles are coated enough with external additive particles, thereby preventing the occurrence of filming and ensuring well fusing.

As described above, according to the first aspect of the invention, the external additive coating ratio of toner particles of which mother particles have equivalent particle diameters larger than the mean particle diameter of the toner is set to be lower than a virtual reference curve, wherein assuming that the external additive coating ratio of a toner particle of which a mother particle has an equivalent particle diameter equal to the mean particle diameter of the toner is a reference value, the virtual reference curve is obtained to satisfy that the external additive coating ratio is constant at the reference value, thereby preventing the occurrence of filming and ensuring well fusing.

Figure 7:
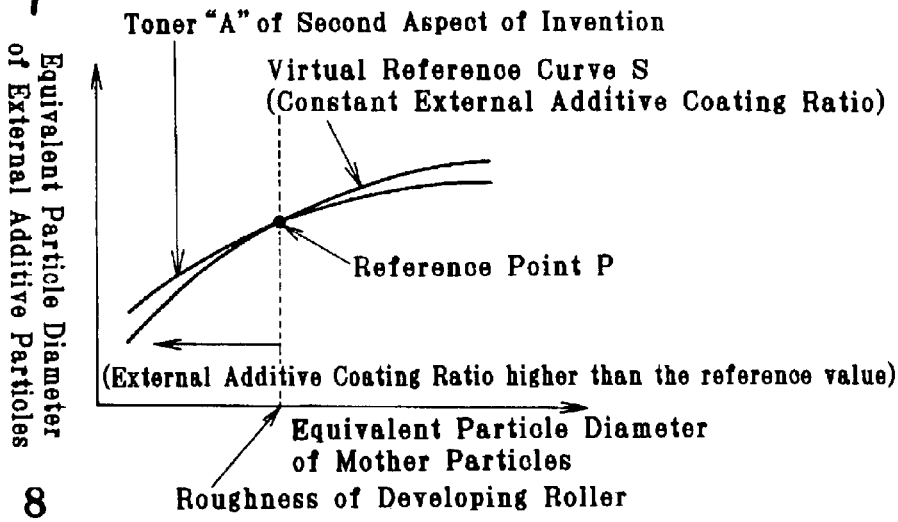
FIG. 7 is a graph for explaining a synchronous distribution curve defining a toner of the second aspect of the invention.

FIG. 7 is a graph for explaining a synchronous distribution curve for defining a synchronous toner indicating the ratio of the amount of mother particles and the amount of external additive particles adhering to the mother particles in a toner of the second aspect of the invention. The abscissa stands for the equivalent particle diameter of the mother particles and the ordinate stands for the equivalent particle diameter of the external additive particles.

A toner of the second aspect of the present invention will now be described. It is assumed that the external additive coating ratio of a toner particle of which a mother particle has an equivalent particle diameter equal to the roughness (the size of concavities) of the developing roller is a reference value (80–120%). A virtual reference curve S passing through a reference point P is plotted to satisfy that the external additive coating ratio is constant at the reference value. The toner is prepared in such a manner that the external additive coating ratio of toner particles of which mother particles have equivalent particle diameters smaller than the roughness of the developing roller is set to be higher than the virtual reference curve S so that the "oil-less fusing" and the elongation of the lifetime of the developing unit are both achieved.

As shown in FIG. 6, toner particles 23 are conveyed to pass between roller 20 and the contact member 22. During this, the toner particles 23 roll along the concavities and convexities of the developing roller. Small toner particles are easy to stay in the concavities of the developing roller and thus easily affected by heat. By setting the external additive coating ratio to be higher than the virtual reference curve S (FIG. 7), the small toner particles are coated enough with external additive particles 24, thereby preventing the occurrence of filming on the developing unit. As for the fusing property of this case, since the surface area relative to the mass of the small toner particles should be large, the small toner particles are easy to receive heat. In addition, since the heat capacity of the small toner particles should be small, the temperature of the small toner particles is easily raised. Therefore, there is little affect on the fusing property even with large external additive coating ratio, whereby the "oil-less fusing" and the elongation of the lifetime of the developing unit are both achieved.

Since large toner particles are difficult to stay in the concavities, toner particles with diameters larger than the roughness of the developing roller are hardly affected by heat even with low external additive coating ratio, so no filming occurs. On the other hand, when the external additive coating ratio is set to be lower, the wax is easily exposed to the surfaces, thereby improving the fusing property. Therefore, the external additive coating ratio of toner particles with diameters larger than the roughness of the developing roller is preferably set to be lower.

The second aspect of the invention is not limited to the toner containing wax and may be adopted to a toner made of low melting point resin without containing wax.

Though the above description was made based on the synchronous distribution curve of the external additive coating ratios, the second aspect of the invention is not limited thereto. For example, assuming that the mean particle diameter of entire toner including synchronous toner particles coated with external additive particles and asynchronous toner particles coated with no or little external additive particles is $D_{total}$ and the mean particle diameter of synchronous toner particles is $D_{doki}$, the toner may be prepared to satisfy the following equation:

$$D_{doki}/D_{total} \leqq 1.$$

Accordingly, in case that the roughness (the size of the concavities) of the developing roller is slightly smaller than the mean particle diameter of the toner, the toner particles with diameters smaller than the roughness of the developing roller are coated with external additive particles at a large coating ratio and the toner particles with diameters larger than the roughness of the developing roller are coated with external additive particles at a small coating ratio, thereby preventing the occurrence of filming and ensuring well fusing.

Alternatively, assuming that the liberated particle ratio of mother particles with particle diameters smaller than the roughness of the developing roller is $\alpha A$ and the liberated particle ratio of mother particles with particle diameters larger than the roughness of the developing roller is $\alpha B$, the toner may be prepared to satisfy the following equation:

$$\alpha A/\alpha B \leqq 1.$$

Accordingly, the toner particles with diameters smaller than the roughness of the developing roller are coated with external additive particles at a large coating ratio and the toner particles with diameters larger than the roughness of the developing roller are coated with external additive particles at a small coating ratio, thereby preventing the occurrence of filming and ensuring well fusing.

As described above, according to the second aspect of the invention, the external additive coating ratio on mother particles with diameters smaller than the roughness of the developing roller is set to be higher than a virtual reference curve, wherein assuming that the external additive coating ratio of a toner particle of which a mother particle has an equivalent particle diameter equal to the roughness of the developing roller is a reference value, the virtual reference curve is obtained to satisfy that the external additive coating ratio is constant at the reference value, thereby preventing the occurrence of filming and ensuring well fusing.

Figure 8:
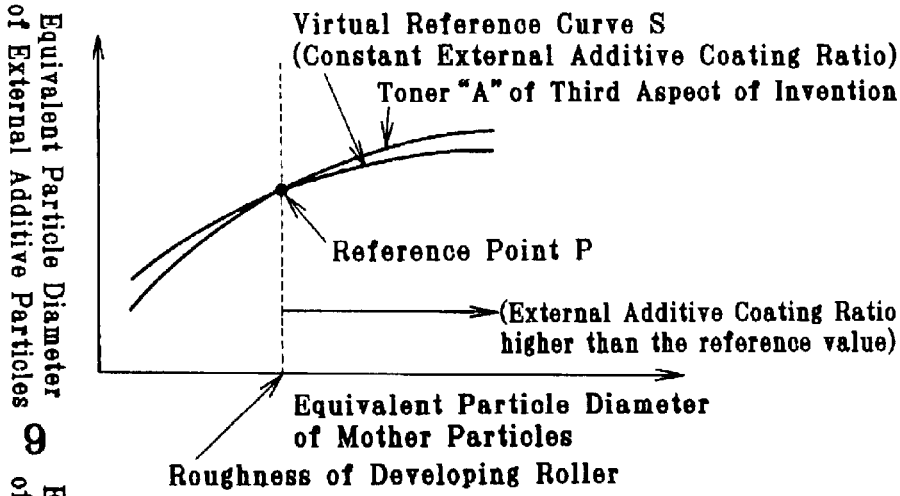
FIG. 8 is a graph for explaining synchronous distribution curve defining a toner of the third aspect of the invention.

FIG. 8 is a graph for explaining a synchronous distribution curve for defining a synchronous toner indicating the ratio of the amount of mother particles and the amount of external additive particles adhering to the mother particles in a toner of the third aspect of the invention. The abscissa stands for the equivalent particle diameter of the mother particles and the ordinate stands for the equivalent particle diameter of the external additive particles.

A toner of the third aspect of the present invention will now be described. It is assumed that the external additive coating ratio of a toner particle of which a mother particle has an equivalent particle diameter equal to the roughness (the size of concavities) of the developing roller is a reference value (80–120%). A virtual reference curve S passing through a reference point P is plotted to satisfy that the external additive coating ratio is constant at the reference value. The toner is prepared in such a manner that the external additive coating ratio of toner particles of which mother particles have equivalent particle diameters larger than the roughness of the developing roller is set to be higher than the virtual reference curve S so that the "oil-less fusing" and the elongation of the lifetime of the developing unit are both achieved.

As shown in FIG. 6, toner particles 23 are conveyed to pass between roller 20 and the contact member 22. During this, the toner particles 23 roll along the concavities and convexities of the developing roller. While small toner particles are easy to stay in the concavities of the developing roller, large toner particles are subjected to large stress from the contact member, resulting in occurrence of filming. Therefore, by setting the external additive coating ratio of toner particles with diameters larger than the roughness of the developing roller to be higher than the virtual reference curve S (FIG. 8), the large toner particles are coated enough with external additive particles, thereby preventing the occurrence of filming due to the stress. As for the fusing property of this case, since the wax in the large toner particles is relatively easily exposed to the surfaces, enough fusing property can be ensured. Therefore, the "oil-less fusing" and the elongation of the lifetime of the developing unit are both achieved.

While small toner particles are easy to stay in the concavities, the small toner particles are subjected to little or small stress from the contact member and the wax therein is relatively hardly exposed to the surfaces, so filming may hardly occur. On the other hand, the fusing property of the small toner particles can be improved by setting the external additive coating ratio to be lower. Therefore, the external additive coating ratio on mother particles with diameters smaller than the roughness of the developing roller is preferably set to be lower.

The third aspect of the invention is not limited to the toner containing wax and may be adopted to a toner made of low melting point resin without containing wax.

Though the above description was made based on the synchronous distribution curve of the external additive coating ratios, the third aspect of the invention is not limited thereto. For example, assuming that the mean particle diameter of entire toner including synchronous toner particles coated with external additive particles and asynchronous toner particles coated with no or little external additive particles is $D_{total}$ and the mean particle diameter of synchronous toner particles is $D_{doki}$, the toner may be prepared to satisfy the following equation:

$$D_{doki}/D_{total} \geqq 1.$$

Accordingly, in case that the roughness (the size of the concavities) of the developing roller is slightly smaller than the mean particle diameter of the toner, the mother particles with diameters larger than the roughness of the developing roller are coated with external additive particles at a large coating ratio and the mother particles with diameters smaller than the roughness of the developing roller are coated with external additive particles at a small coating ratio, thereby preventing the occurrence of filming and ensuring well fusing.

Alternatively, assuming that the liberated particle ratio of mother particles with particle diameters smaller than the roughness of the developing roller is $\alpha A$ and the liberated particle ratio of mother particles with particle diameters larger than the roughness of the developing roller is $\alpha B$, the toner may be prepared to satisfy the following equation:

$$\alpha A/\alpha B \geqq 1.$$

Accordingly, the mother particles with diameters larger than the roughness of the developing roller are coated with external additive particles at a large coating ratio and the mother particles with diameters smaller than the roughness of the developing roller are coated with external additive particles at a small coating ratio, thereby preventing the occurrence of filming and ensuring well fusing.

As described above, according to the third aspect of the invention, the external additive coating ratio on mother particles with diameters larger than the roughness of the developing roller is set to be higher than a virtual reference curve, wherein assuming that the external additive coating ratio of a toner particle of which a mother particle has an equivalent particle diameter equal to the roughness of the developing roller is a reference value, the virtual reference curve is obtained to satisfy that the external additive coating ratio is constant at the reference value, thereby preventing the occurrence of filming and ensuring well fusing.

Figure 9:
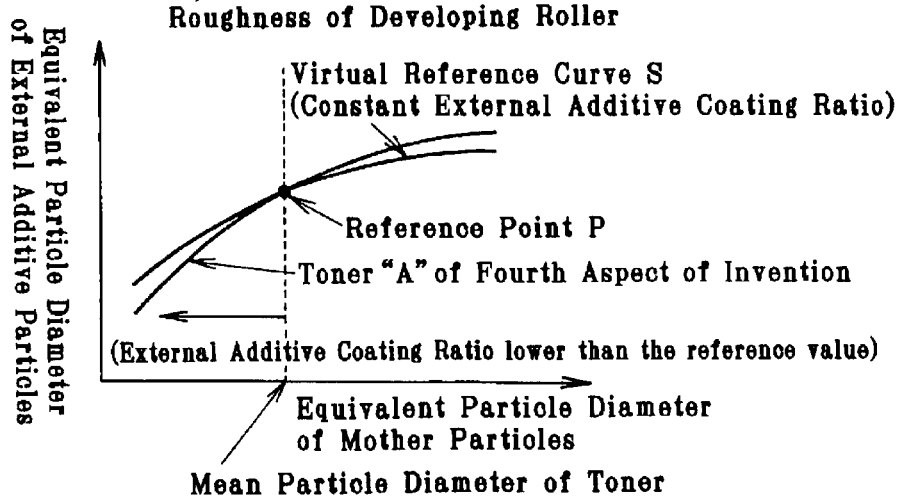
FIG. 9 is a graph for explaining synchronous distribution curve defining a toner of the fourth aspect of the invention.

FIG. 9 is a graph for explaining a synchronous distribution curve for defining a synchronous toner indicating the ratio of the amount of mother particles and the amount of external additive particles adhering to the mother particles in a toner of the fourth aspect of the invention. The abscissa stands for the equivalent particle diameter of the mother particles and the ordinate stands for the equivalent particle diameter of the external additive particles.

A toner of the fourth aspect of the present invention will now be described. It is assumed that the external additive coating ratio of a toner particle of which a mother particle has an equivalent particle diameter equal to the mean particle diameter of the toner is a reference value (80–120%). A virtual reference curve S passing through a reference point P is plotted to satisfy that the external additive coating ratio is constant at the reference value. The toner is prepared in such a manner that the external additive coating ratio of toner particles of which mother particles have equivalent particle diameters smaller than the mean particle diameter of the toner is set to be lower than the virtual reference curve S so that the "oil-less fusing" and the elongation of the lifetime of the developing unit are both achieved.

As shown in FIG. 6, toner particles 23 are conveyed to pass between roller 20 and the contact member 22. During this, the toner particles 23 roll along the concavities and convexities of the developing roller. While small toner particles are easy to stay in the concavities of the developing roller, the small toner particles are subjected to little or small stress from the contact member and the wax therein is relatively hardly exposed to the surfaces, so filming may hardly occur. Therefore, toner particles with diameters smaller than the mean particle diameter of the toner do not cause filming even with low external additive coating ratio. On the other hand, the lower external additive coating ratio improves the fusing property. As mentioned above, by setting the external additive coating ratio of toner particles with diameters smaller than the mean particle diameter of the toner to be lower, the fusing property is improved and the occurrence of filming on the developing unit can be prevented, thereby enabling that the "oil-less fusing" and the elongation of the lifetime of the developing unit are both achieved.

Large toner particles are subjected to large stress from the contact member, resulting in occurrence of filming. Therefore, by setting the external additive coating ratio of toner particles with diameters larger than the mean particle diameter of the toner to be higher, the large toner particles are coated enough with external additive particles, thereby preventing the occurrence of filming due to the stress. As for the fusing property of this case, the wax in the large toner particles is easily exposed to the surfaces, thereby ensuring enough fusing property. Therefore, there is no problem with the fusing property.

The fourth aspect of the invention is not limited to the toner containing wax and may be adopted to a toner made of low melting point resin without containing wax.

Though the above description was made based on the synchronous distribution curve of the external additive coating ratios, the fourth aspect of the invention is not limited thereto. For example, assuming that the mean particle diameter of entire toner including synchronous toner particles coated with external additive particles and asynchronous toner particles coated with no or little external additive particles is $D_{total}$ and the mean particle diameter of synchronous toner particles is $D_{doki}$, the toner may be prepared to satisfy the following equation:

$$D_{doki}/D_{total} \geqq 1.$$

Accordingly, the small toner particles are coated with external additive particles at a small coating ratio and the large toner particles are coated enough with external additive particles, thereby preventing the occurrence of filming and ensuring well fusing.

Alternatively, assuming that the liberated particle ratio of mother particles with particle diameters smaller than the mean particle diameter is $\alpha A$ and the liberated particle ratio of mother particles with particle diameters larger than the mean particle diameter is $\alpha B$, the toner may be prepared to satisfy the following equation:

$$\alpha A/\alpha B \geqq 1.$$

Accordingly, the small toner particles are coated with external additive particles at a small coating ratio and the large toner particles are coated enough with external additive particles, thereby preventing the occurrence of filming and ensuring well fusing.

As described above, according to the fourth aspect of the invention, the external additive coating ratio of toner particles of which mother particles have equivalent particle diameters smaller than the mean particle diameter of the toner is set to be lower than a virtual reference curve, wherein assuming that the external additive coating ratio of a toner particle of which a mother particle has an equivalent particle diameter equal to the mean particle diameter of the toner is a reference value, the virtual reference curve is obtained to satisfy that the external additive coating ratio is constant at the reference value, thereby preventing the occurrence of filming and ensuring well fusing.

It should be noted that the toners of the aforementioned aspects of the invention may be of a negative polarity or of a positive polarity. The mother particles comprises at least a base resin forming the toner, a charge controlling agent for controlling the amount of charge, a pigment, an external additive, a releasing agent, a magnetic material, and other additives.

The material for the mother particles may be selected from a group consisting of: polystyrene and copolymers thereof, for example, hydrogenated styrene resin, styrene-isobutyrene copolymer, ABS resin, ASA resin, AS resin, AAS resin, ACS resin, AES resin, styrene-P-chlorostyrene copolymer, styrene-propylene copolymer, styrene-butadiene crosslinked polymer, styrene-butadiene-chlorinated paraffin copolymer, styrene-allyl-alcohol copolymer, styrene-butadiene rubber emulsion, styrene ester maleate copolymer, styrene-isobutylene copolymer, and styrene-maleic anhydride copolymer; acrylate resins and methacrylate resins and their copolymers; styrene-acrylic resins and their copolymers, for example, styrene-acryl copolymer, styrene-diethylamino-ethylmethacrylate copolymer, styrene-butadiene-acrylic ester copolymer, styrene-methylmethacrylate copolymer, styrene-n-butylacrylate copolymer, styrene-methylmethacrylate-n-butylmethacrylate copolymer, styrene-methylmethacrylate-butylarylate-N-(ethoxymethyl) acrylamide copolymer, styrene-glycidylmethacrylate copolymer, styrene-butadiene-dimethyl-aminoethylmethacrylate copolymer, styrene ester acrylic ester maleate copolymer, styrene-methyl methacrylate-acrylic acid-2-ethylhexyl copolymer, styrene-n-butylarylate-ethylglycolmethacrylate copolymer, styrene-n-butylmethacrylate-acrylic acid copolymer, styrene-n-butylmethacrylate-maleic anhydride copolymer, styrene-butyl acrylate-isobutyl maleate half ester-divinylbenzene copolymer; polyesters and copolymers thereof; polyethylene and copolymers thereof; epoxy resins; silicone resins; propylene and copolymers thereof; fluororesins; polyamide resins; polyvinyl alcohol resins; polyurethane resins; and polyvinylbutyral resin. Any one of the foregoing materials may be employed singly or a blend of any two or more materials may be employed.

The coloring agent may be carbon black, spirit black, nigrosine, rhodamine dyes, triaminotriphenylmethane, cation dyes, dioxazine, copper phthalocyanine, perylene, azo dyes, auriferous azo pigment, azochrome complex, carmine dyes, benzidine dyes, solar pure yellow 8G, quinacridon, polytungstophosphate, Indanthrene Blue, sulfonamide derivative or the like.

The charge controlling agent may be an electron-acceptable organic complex, chlorinated polyester, nitrohumic acid, quaternary ammonium salt, or pyridinium salt. The releasing agent may be polypropylene wax, polyethylene wax, or the like. The dispersant may be metallic soap, polyethylene glycol or the like. Other additives may be zinc stearate, zinc oxide, cerium oxide or the like.

Furthermore, the magnetic material may be metal powder of Fe, Co, Ni, Cr, Mn or Zn; metal oxide, such as $Fe_3O_4$, $Fe_2O_3$, $Cr_2O_3$ or ferrite; an alloy, such as an alloy containing manganese and acid, which is provided with a ferromagnetic characteristic by heat treatment; or the like and may be previously treated by using a coupling material. The foregoing materials are formed into the mother particles by a usual kneading pulverization method, a spray and dry method, or a polymerizing method.

On the other hand, the external additive may be inorganic fine particles of metal oxide, such as silica, alumina, and titanium oxide, or their composite oxide; or organic fine particles, for example, acryl fine particles. As its surface treatment material, a silane coupling agent, a titanate coupling agent, a fluorine-contained silane coupling agent, or silicone oil may be employed. It is preferable that the hydrophobic ratio of the external additive processed with the foregoing processing agent is 60% or higher when the ratio is measured by a conventional methanol method. If the ratio is lower than this value, deterioration in the electrification characteristic and fluidity easily occurs in a hot and wet environment owning to adsorption of water. It is preferable that the particle diameter of the external additive is 0.001 $\mu$m to 1 $\mu$m from a viewpoint of improving the transporting property and the charging property. It is preferable that the adding amount of the external additive is 0.1 wt % to 5 wt % relative to the mother particles of toner. If the amount is larger than this value, the possibility of making external additive particles asynchronous with mother particles of toner is raised. Thus, secondary coagulation of external additive particles frequently occurs, causing determination in the electrification characteristic and increase in the number of linear stains.

The external additive is not limited to only one kind and may be prepared by mixing two or more kinds of additives. The toners of the respective aspects of the invention can be prepared by mixing the mother particles and the external additive particles in a dry state so as to adhere to one another by using a high-speed fluidization mixing machine, such as a Henschel mixer or Perpen mayer or a mixing machine using a mechanochemical method.

The fifth aspect of the present invention is an image forming apparatus comprising at least a latent image carrier on which an electrostatic latent image is formed, a developing unit for developing the electrostatic latent image on the latent image carrier with a toner, a transfer means for transferring the developed image on the latent image carrier, and a fusing means for fusing the transferred image and being characterized by using any one of the toners of the aforementioned aspects of the invention. The image forming apparatus using the toner of the invention is not limited to an image forming apparatus having an intermediate transfer member and may be an image forming apparatus in which an image on a photoreceptor (latent image carrier) is directly transferred to a paper and the transferred image is fused, including such an apparatus that is improved for ensuring the fusing property of the fusing unit and elongation of the lifetime of the developing unit.

What we claim is:

1. A toner comprising:

first mother particles each having a first equivalent particle diameter which is larger than a mean particle diameter of the toner; and second mother particles each having a second equivalent particle diameter equal to a mean particle diameter of the toner;

wherein an external additive coating ratio of toner particles, including the first mother particles, is set to be lower than a virtual reference curve in synchronous distribution of equivalent particle diameters of synchronous external additive particles relative to equivalent particle diameters of mother particles, wherein assuming that the external additive coating ratio of the second mother particles is a reference value, the virtual reference curve is obtained to satisfy that the external additive coating ratio is constant at the reference value.

2. A toner as claimed in claim 1, wherein the external additive coating ratio at the reference value is in a range from 80% to 120%.

3. A toner comprising:

toner particles having diameters larger than a mean particle diameter of the toner; and synchronous toner particles having external additive particles adhereing thereto, wherein the mean particle diameter of the synchronous toner particles is set to be smaller than a mean particle diameter of the entire toner, whereby an external additive coating ratio of the toner particles having diameters larger than the mean particle diameter of the toner is set to be lower.

4. A toner comprising:

first mother particles having first particle diameters smaller than a mean particle diameter of the toner; and second mother particles having second particle diameters larger than the mean particle diameter of the toner, wherein, a liberated particle ratio of the first mother particles is set to be lower than a liberated particle ratio of the second mother particles, whereby an external additive coating ratio of toner particles with diameters larger than the mean particle diameter of the toner is set to be lower.

5. A toner comprising:

first mother particles having a first equivalent particle diameter smaller than a roughness of a developing roller; and second mother particles having a second equivalent particle diameter equal to a roughness of a developing unit, wherein an external additive coating ratio of toner particles, including the first mother particles, is set to be higher than a virtual reference curve in synchronous distribution of the equivalent particle diameters of synchronous external additive particles relative to the equivalent particle diameters of mother particles, and wherein assuming that an external additive coating ratio of the second mother particles is a reference value, the virtual reference curve is obtained to satisfy that the external additive coating ratio is constant at the reference value.

6. A toner as claimed in claim 5, wherein the external additive coating ratio at the reference value is in a range from 80% to 120%.

7. A toner comprising:

synchronous toner particles with external additive particles adhering thereto; and toner particles with diameters smaller than the roughness of a developing roller, wherein a mean particle diameter of the synchronous toner particles is set to be smaller than a mean particle diameter of the entire toner, whereby an external additive coating ratio of the toner particles with diameters smaller than the roughness of the developing roller is set to be higher.

8. A toner comprising:

first mother particles having a first diameter smaller than a roughness of a developing roller; and second mother particles having second diameters larger than a roughness of the developing roller, wherein a liberated particle ratio of the first mother particles is set to be lower than the liberated particle ratio of the second mother particles, whereby the external additive coating ratio of toner particles with diameters smaller than the roughness of the developing roller is set to be higher.

9. A toner comprising:

first mother particles having equivalent particle diameters larger than a roughness of a developing roller; and second mother particles having an equivalent particle diameter equal to the roughness of a developing unit, wherein an external additive coating ratio of toner particles having the first mother particles is set to be higher than a virtual reference curve in synchronous distribution of equivalent particle diameters of synchronous external additive particles relative to equivalent particle diameters of mother particles, wherein assuming that an external additive coating ratio of a toner particle having the second mother particle is a reference value, the virtual reference curve is obtained to satisfy that the external additive coating ratio is constant at the reference value is a reference.

10. A toner as claimed in claim 9, wherein the external additive coating ratio at the reference value is in a range from 80% to 120%.

11. A toner comprising:

synchronous toner particles having diameters smaller than a roughness of a developing roller; and toner particles having diameters larger than the roughness of the developing roller, wherein a mean particle diameter of synchronous toner particles with external additive particles adhering thereto is set to be larger than a mean particle diameter of the entire toner, whereby an external additive coating ratio of the toner particles with diameters larger than the roughness of the developing roller is set to be higher.

12. A toner comprising:

first mother particles having first diameters smaller than the roughness of a developing roller; and second mother particles having second diameters larger than the roughness of the developing roller, wherein a liberated particle ratio of the first mother particles is set to be higher than a liberated particle ratio of the second mother particles, whereby an external additive coating ratio of toner particles with diameters larger than the roughness of the developing roller is set to be higher.

13. A toner comprising:

first mother particles having an equivalent particle diameter smaller than a mean particle diameter of the toner;

second mother particles having an equivalent particle diameter equal to the mean particle diameter of the toner, wherein an external additive coating ratio of toner particles having the first mother particles is set to be lower than a virtual reference curve in synchronous distribution of equivalent particle diameters of synchronous external additive particles relative to equivalent particle diameters of mother particles, wherein assuming that an external additive coating ratio of a toner particle having the second mother particles is a reference value, a virtual reference curve is obtained to satisfy that the external additive coating ratio is constant at the reference value is a reference.

14. A toner as claimed in claim 13, wherein the external additive coating ratio at the reference value is in a range from 80% to 120%.

15. A toner comprising:

synchronous toner particles having external additive particles adhering thereto; and toner particles having diameters smaller than the mean particle diameter of the toner, wherein a mean particle diameter of the synchronous toner particles is set to be larger than a mean particle diameter of the entire toner, whereby an external additive coating ratio of the toner particles with diameters smaller than the mean particle diameter of the toner is set to be lower.

16. A toner comprising:

first mother particles having diameters smaller than a mean particle diameter of the toner; and second mother particles having second diameters larger than the mean particle diameter of the toner, wherein a liberated particle ratio of the first mother particles is set to be higher than a liberated particle ratio of the second mother particles, whereby an external additive coating ratio of toner particles with diameters smaller than the mean particle diameter of the toner is set to be lower.

17. An image forming apparatus comprising:

a latent image carrier on which an electrostatic latent image is formed;

a developing unit for developing the electrostatic latent image on the latent image carrier with a toner;

a transfer means for transferring the developed image on the latent image carrier; and a fusing means for fusing the transferred image, wherein the toner is a toner as claimed in any one of claims 1 through 16.

* * * * *